US011020716B2

(12) United States Patent
Grünenfelder

(10) Patent No.: US 11,020,716 B2
(45) Date of Patent: Jun. 1, 2021

(54) STATIC MIXER, METHOD OF ASSEMBLING A STATIC MIXER AND DISPENSING APPARATUS

(71) Applicant: Sulzer Mixpac AG, Haag (CH)

(72) Inventor: Ralf Grünenfelder, Wangs (CH)

(73) Assignee: SULZER MIXPAC AG, Haag (CH)

( * ) Notice: Subject to any disclaimer, the term of this patent is extended or adjusted under 35 U.S.C. 154(b) by 158 days.

(21) Appl. No.: 15/755,786

(22) PCT Filed: Aug. 11, 2016

(86) PCT No.: PCT/EP2016/069187
§ 371 (c)(1),
(2) Date: Feb. 27, 2018

(87) PCT Pub. No.: WO2017/036759
PCT Pub. Date: Mar. 9, 2017

(65) Prior Publication Data

US 2019/0030499 A1 Jan. 31, 2019

(30) Foreign Application Priority Data

Aug. 28, 2015 (EP) ..... 15182961

(51) Int. Cl.
*B01F 5/06* (2006.01)
*B01F 15/00* (2006.01)

(52) U.S. Cl.
CPC ..... *B01F 5/0641* (2013.01); *B01F 15/00935* (2013.01); *B01F 2215/0039* (2013.01)

(58) Field of Classification Search
CPC ..... B01F 5/0641
USPC ..... 366/336–340
See application file for complete search history.

(56) References Cited

U.S. PATENT DOCUMENTS 4,123,178 A * 10/1978 Salzman ..... B01F 5/0656 366/338
4,305,672 A * 12/1981 Adams ..... B01F 5/0644 366/336
5,413,253 A 5/1995 Simmen
5,487,606 A 1/1996 Keller
7,325,970 B2 2/2008 Keller
8,033,429 B2 * 10/2011 Keller ..... B05C 17/00506 222/137

(Continued)

FOREIGN PATENT DOCUMENTS

EP 0584428 A 3/1994
EP 1426099 A1 6/2004

(Continued)

OTHER PUBLICATIONS

International Search Report dated Nov. 25, 2016 in corresponding International Application No. PCT/EP2016/069187, filed Aug. 11, 2016.

(Continued)

*Primary Examiner* — David L Sorkin
(74) *Attorney, Agent, or Firm* — Global IP Counselors, LLP

(57) ABSTRACT

A static mixer for mixing together at least two components includes a mixer housing, a mixing element arranged at least partly within the mixer housing, and a mixer inlet section having at least two inlets at an input side and at least two outlets at an output surface.

19 Claims, 12 Drawing Sheets

(56) References Cited

U.S. PATENT DOCUMENTS

| | | | | |
|---|---|---|---|---|
| 8,147,122 | B2 * | 4/2012 | Pieroni | B01F 7/008 222/145.6 |
| 8,322,909 | B2 * | 12/2012 | Gramann | B01F 7/00291 366/172.2 |
| 2008/0056065 | A1 * | 3/2008 | Keller | B01F 5/0612 366/339 |
| 2010/0200614 | A1 | 8/2010 | Von Rotz | |
| 2010/0256591 | A1 | 10/2010 | Ho et al. | |
| 2013/0182529 | A1 | 4/2013 | Linne | |
| 2013/0135963 | A1 | 5/2013 | Linne et al. | |
| 2014/0301154 | A1 | 10/2014 | Bublewitz et al. | |

FOREIGN PATENT DOCUMENTS

| | | | |
|---|---|---|---|
| EP | 2599540 | A1 | 6/2013 |
| EP | 2614883 | A1 | 7/2013 |

OTHER PUBLICATIONS

International Preliminary Report on Patentability and Written Opinion dated Mar. 6, 2018 in corresponding International Application No. PCT/EP2016/069187, filed Aug. 11, 2016.

* cited by examiner

STATIC MIXER, METHOD OF ASSEMBLING A STATIC MIXER AND DISPENSING APPARATUS

CROSS-REFERENCE TO RELATED APPLICATION

This application is a U.S. National Stage application of International Application No. PCT/EP2016/069187, filed Aug. 11, 2016, which claims priority to European Application No. 15182961.1, filed Aug. 28, 2015, the contents of each of which are hereby incorporated herein by reference.

BACKGROUND

Field of the Invention

The present invention relates to a static mixer for mixing together at least two components comprising: a mixer housing; a mixing element arranged at least partly within the mixer housing; and a mixer inlet section having at least two inlets disposed at an input side and at least two outlets disposed at an output surface. The invention further relates to a dispensing apparatus and to a method of assembling a static mixer.

Background of the Invention

A wide variety of ways of dispensing two-component masses from cartridges is known in the prior art. The materials to be dispensed are typically a matrix material and a hardener. Two-component materials are typically used as impression materials, e.g. on the formation of dental impressions, as a cement material for prosthetic restorations, as a temporary cement for trial cementing restorations or for cementing temporary crowns. Further applications of two-component materials are in the building industry where they are e.g. used as a replacement for mechanical joints that corrode over time. Adhesive bonding can be used to bond products such as windows and concrete elements. The use of multi-component protective coatings, for example moisture barriers, corrosion protection and anti-slip coatings, is also becoming increasingly common. Examples of flowable materials which can be used are, for example, distributed by the company Coltene using the tradename AFFINIS® or by the company DMG using the tradename PermaCem.

The following kinds of two-component materials are used in the building industry:

- epoxy highly filled with fillers, such as carbon black or silica, used e.g. as a filling paste or putty;
- silane-modified polyurethane (PU) used e.g. as a sealant;
- PU acrylate resin used e.g. as an adhesive for windscreens; and
- poly sulfides used e.g. as an oil resistant sealant that is provided between concrete panels at gas or petrol stations.

These materials are typically highly viscous and are almost solid and hence require large static mixers, having a diameter typically larger than 10 mm, in order to be discharged from a cartridge and subsequently mixed.

SUMMARY

Filled cartridges can come in different ratios referred to as 1:1, 2:1, 4:1 and 10:1 etc., the numbers specifying the ratios of the amounts of each of the two materials that are to be dispensed. The reason for these different ratios is to allow a wide variety of different compositions to be mixed and dispensed. For example, some compositions require more hardener, and some require less hardener. Also, some compositions require more mixing.

Static mixers, also referred to as mixing tips, are known from the prior art. The static mixers are adapted to mix the compositions as they exit the cartridge. In this respect different length and different diameter mixing tips are provided to ensure a thorough through mixing of the various two-component mixtures. The mixing tips typically have an insert resembling e.g. an open spiral which forces the two-components into contact with one another and exerts forces on them causing them to mix.

The individual components of the multi-components to be mixed are frequently fairly expensive so there is a need to reduce the volume of material lost after a mixing process has taken place. This is in particular true for large static mixers, i.e. static mixers typically having diameters larger than 10 mm, that are used e.g. in the building industry. In order to reduce the volume remaining in a static mixer, specific designs have been implemented resulting in a reduced length static mixer. However, the reduction in length has led to very complicated designs of static mixers. Since the static mixers are frequently manufactured in an injection molding process, the production of static mixers has become very demanding in effort and cost, as highly complex molds are necessary. At times the manufacture may be impossible, as the provision of undercuts and recesses in the static mixer means that the previously used molds can no longer be used.

For this reason it is an object of the present invention to provide a static mixer in which the volume of the multi-component material left after use of the static mixer is reduced in comparison to the prior art. It is a further object of the invention to provide a static mixer in which the flow of multi-components through the static mixer is improved. It is yet a further object of the invention to provide a static mixer in which the through mixing of the multi-components is improved.

This object is satisfied by a static mixer having the features discussed herein.

In particular, such a static mixer is suitable for mixing together at least two components and comprises: a mixer housing; a mixing element arranged at least partly within the mixer housing; and a mixer inlet section having at least two inlets provided at an input side and at least two outlets provided at an output surface; wherein the at least two outlets are in fluid communication with the at least two inlets; and wherein the mixer housing, the mixing element and the mixer inlet section are formed as separate elements. The static mixer is characterized in that the mixing element comprises a plug element and the mixer inlet section comprises a counter plug element engaging the plug element. The static mixer is further characterized in that the mixing element and the mixer inlet section are plugged together in a rotationally fixed manner by a plugged connection.

Providing a three part static mixer enables the use of molds for injection molded processes to produce the static mixer. This leads to a reduction in the cost of manufacture and to reproducible production results.

Moreover, the handling and assembly of the static mixer is improved as the three parts can simply be plugged together after their respective production.

Furthermore, as the mixer inlet section and the mixing element are plugged together in a rotationally fixed manner, the mixing process is improved. This is because the orientation of the two parts relative to one another is improved, so that the components to be mixed are guided and fed into the mixing element such that the components arrive at the correct inlets of the mixing element improving the mixing result and more importantly also allowing a reduction in length of the static mixer. A reduction in length of the static mixer leads to a reduction in any residual volume that is left in the static mixer after its use.

In this connection it must be noted that the plug element and the counter plug element can be a plug and socket type connection. In one design the socket can be disposed at the mixing element, in a different design the socket can be provided at the mixer inlet section. The corresponding plug is then disposed at the other element.

Having regard to medium to high mixing ratios of 2:1, 4:1 or 10:1 etc, the flow of the low volume component can be controlled by maintaining a diameter of the flow path to the mixing element comparatively small and to introduce this component directly into the optimal spot of the mixing geometry and to thereby permit the other component to enter the mixing geometry at the position ideal for it and to thereby prevent undue forerunning of either of the components.

Similar guide mechanisms can also be employed for low to medium mixing ratios of 1:1 to 2:1 mixers using a static mixer in accordance with the invention, making the concept universally applicable to static mixers.

By providing a plug element and a counter plug element to connect the mixer inlet section and the mixing element, a distance between the mixing element and the mixer inlet section can be reduced. A reduction in the distance between the mixing element and the mixer inlet section leads to a reduction in the residual volume of components left behind in the static mixer.

In this connection it should be noted that the feature according to which the mixing element is at least partly provided within the housing means that at least mixer elements of the mixing element are arranged within the mixer housing and that, for example, components of the plug element may project out of the mixer housing in order to cooperate with the mixer inlet section. In this regard at least 70%, preferably 80 to 95% of the mixing element are typically arranged within the mixer housing.

Preferably the mixing element and the mixer inlet section are held together in an axial direction by the plugged connection that is formed by the plug element and the counter plug element and/or by at least one element of the mixer inlet section cooperating with at least one element of the mixer housing.

Forming the plugged connection between the mixer inlet section and the mixing element ensures that these components can remain connected outside of the housing. Alternatively or additionally forming the plugged connection between the housing and the mixer inlet section ensures that the three parts can be connected to one another in a preferably secure manner, such that any pressure arising within the static mixer does not result in the static mixer coming apart.

Advantageously the plugged connection, preferably between the plug element and the counter plug element, comprises a clamping connection and/or a frictional connection, such as at least one nose frictionally engages one of the mixer inlet section and the mixing element, and/or a latching connection of the plug element and the counter plug element. Such connections can easily be produced in a cost effective manner.

It is preferred if the mixing element and the mixer inlet section are aligned in a fixed predefined rotational angular relationship by the plug element and the counter plug element.

In this connection a predefined rotational angular relationship means that when the mixing element and the mixer inlet section are plugged together by the plugged connection that the outlets of the mixer inlet section are aligned relative to the mixing element.

Utilizing the plug and counter plug element to achieve the fixed predefined rotational angular relationship means that the two components mixing element and mixer inlet section can be tailored to one another to permit the desired flow of components from he mixer inlet section into the mixing element.

Optionally the plug element and the counter plug element comprise coding means or element, in particular a thickened end or a bulge cooperating with a corresponding recess or groove, allowing the mixing element and the mixer inlet section to be plugged together only in the predefined rotational angular relationship.

The provision of coding element advantageously permits the correct placement of the plug element relative to the counter plug element to ensure, on the one hand, the predefined rotational angular relationship, and, on the other hand, the correct alignment of the two components relative to one another.

In this connection it should be noted that the thickened end or bulge can be provided on either of the plug element and the counter plug element and that the corresponding recess or groove is then respectively provided on the other one of the plug element and the counter plug element.

The plug element preferably comprises a wall section provided at an input end of the mixing element and the counter plug element comprises a groove provided on the output surface. Providing the plug element at the mixing element and the corresponding socket at the mixer inlet section makes these parts particularly simple to manufacture.

In this connection it should be noted that the coding element can be provided at the wall section, so that the wall section advantageously carries out an alignment and coding function.

In a preferred design the wall section is arranged between the at least two outlets so as to separate the components leaving the at least two outlets before entering inlets of the mixing element. Providing the wall section such that the components are separate from one another before entering inlets of the mixing element ensures the optimum mixing results and hence permits a reduction in the length of the mixing element.

Preferably the wall section has a straight planar shape, and/or comprises a thickened end, and/or has at least partially a U-shaped cross section, and/or has at least partially a T-shaped cross section.

Such shapes have been found to be beneficial to ensure the connection between the mixing element and the mixer inlet section in a rotationally fixed manner and indeed even in a coded manner, so that the components can only be plugged together in one orientation.

Providing a wall section having a U-shaped cross-section, for example, enables the provision of a groove within the wall section of the plug element. This groove can then act as an extension of the flow path from the inlet of the mixer inlet section to the mixing element.

Advantageously the at least two inlets have respective inlet openings and the at least two outlets have outlet openings, with the outlet openings being formed in the output surface of the mixing inlet, wherein a surface area of at least one of the inlet openings is smaller than a surface area of the corresponding outlet opening.

Providing at least one outlet opening that is larger in area than an inlet opening means that one can manipulate the flow of at least one component in the direction towards the mixing element in a desired way.

It is preferred if the output surface of the mixer inlet section has an at least substantially slanted contour at an outlet side of the mixer inlet section with respect to a longitudinal axis of the static mixer, with the outlet side being disposed remote from the inlet side, with the at least substantially slanted contour of the output surface preferably being adapted to a shape of an inlet surface of the mixer housing.

Forming the output surface of the mixer inlet section in a convex manner and correspondingly adapting the inlet surface of the mixer housing means that a flow path extending through the mixer inlet section can be extended from the outlet of the mixer inlet section to the inlets of the mixing element in a desired way through cooperation with the housing. This means that there is no region between the outlets of the mixer inlet section and the inlets into the mixing element in which the flow path of the components experiences an unwanted deflection at the mixer housing. This leads to improved mixing results.

In this connection it must be noted that the slanted contour means that the correspondingly convexly shaped surface can be formed as part conical or cone shaped, part truncated cone like, as part chamfered surfaces or as part pyramid like surfaces etc. The specific shape chosen is ideally selected to ensure the optimum flow path to the inlets of the mixing element.

In this connection it should also be noted that the at least substantially convexly shaped surface, respectively the at least substantially slanted contour, refers to the general shape of that part of the surface of the mixer inlet section that is adjacent to the mixer housing and in which no openings, such as the outlet openings or the counter plug element are provided.

Preferably the static mixer has a longitudinal axis and at least two flow paths extend between the at least two inlet and outlet openings, wherein each inlet and outlet opening has a geometric center, with the geometric center of at least one, preferably of each, of the at least two outlet openings being spaced less far apart from the longitudinal axis than the geometric center of at least one, preferably of each, of the at least two inlet openings.

Guiding the flow paths of components to be mixed towards the longitudinal axis through the mixer inlet section means that the components can enter the mixing element at the optimum spot.

Advantageously, in a region of the at least two outlets, the at least two flow paths are configured to cooperate with the mixer housing, preferably with an inlet surface of the mixer housing, to provide a component flow guide region at inlets of the mixing element, wherein the at least two outlets of the mixer inlet section are preferably arranged to at least partly overlap with inlets of the mixing element, in particular with the inlets of the mixing element being formed by the mixing element and/or by spaces formed between the mixing element and an internal wall of the mixer housing.

Such a design leads to an improved flow path between the mixer inlet section and the mixing element in which the flow path of the components experiences less unwanted deflections at the mixer housing leading to improved mixing results.

It is preferred if at least one region of at least one of the at least two outlets adjacent to the corresponding outlet opening is configured such that its cross-section perpendicular to the respective one of the at least two flow paths is enlarged in comparison to the corresponding inlet, in particular such that the flow path extending between the inlet opening and the outlet opening is directed and enlarged in a direction towards at least one inlet of the mixer element.

Enlarging a volume of the outlet in the region of the outlet opening means that a flow path towards the inlets of the mixing element can be tailored to direct the components towards the mixing element.

Advantageously the mixing element comprises a plurality of mixer elements arranged one after another for a repeated separation and re-combination of streams of the components to be mixed.

It is preferred if at least one recess is provided at an outlet side of the mixer inlet section, wherein one of the at least two outlets opens into a base of the at least one recess. Such a recess advantageously forms a collecting region for a component to be directed into the inlets of the mixing element.

Advantageously a cross-sectional area of the at least one recess is preferably larger than the cross-sectional area of the one of the at least two outlets. Such a recess provides a comparatively large volume collecting region for guiding the component towards the inlets of the mixing element.

The depth of the recess in the axial direction can preferably amount to at least a third, in particular to at least half of the diameter of the outlet, alternatively the depth of the recess in the axial direction is preferably equal to or larger than the diameter of the outlet. Such a recess also provides a comparatively large volume collecting region for guiding the component towards the inlets of the mixing element.

Preferably the at least one recess has a cross-sectional shape that deviates from a circle. Advantageously such that the at least one recess has an elongate shape that is in particular extended towards the longitudinal axis. Thereby an as large as possible free space is generated in the mixer inlet section for the collection region. In this connection it should be noted that a recess can be disposed within each outlet, to provide an as large as possible free space for the collection region provided for each outlet.

In some designs it can be advantageous if the at least one recess is connected to the other one of the at least two outlets and/or to a further recess in a direction transverse to the longitudinal axis. Thereby at least one maximum volume collecting region can be generated in the mixer inlet section.

In this connection it should be noted that once the plug element engages the counter plug element the two outlets are separated, so that a maximum volume collecting region can be generated in the mixer inlet section for each outlet and hence for each flow path.

For an as good as possible mixing result the mixing element can comprise mixer elements for separating the material to be mixed into a plurality of streams, as well as means for the layered merging of the same, including a transverse edge and guide walls that extend at an angle to said transverse edge, as well as guide elements arranged at an angle to the longitudinal axis and provided with openings, wherein said mixing element comprises a transverse edge and a following transverse guide wall and at least two guide walls ending in a separating edge each with lateral end sections and with at least one bottom section disposed between said guide walls, thereby defining at least one opening on one side of said transverse edge and at least two openings on the other side of said transverse edge.

Alternatively the mixing element can comprise mixer elements for separating the material to be mixed into a plurality of streams, as well as a structure or means for the layered merging of the same, including separating edges and a transverse edge that extends at an angle to said separating edges, as well as deflecting elements arranged at an angle to the longitudinal axis and provided with openings, wherein said mixing element comprises at least two separating edges with following guide walls with lateral end sections and with at least one bottom section disposed between said guide walls, and a transverse edge arranged at one end of a transverse guide wall, thereby defining at least one opening on one side of the transverse edge and at least two openings on the other side of the transverse edge.

In a further aspect the present invention relates to a dispensing apparatus comprising a multi-component cartridge and a static mixer as described in the foregoing that is connected to the multi-component cartridge, with the multi-component cartridge preferably being filled with respective components.

Preferably the mixer elements of the mixing element are held together by struts, with the struts also acting as further guide and deflecting walls.

Such designs of mixing elements have been found particularly advantageous to improve the mixing results and at the same time to achieve the desired reduction in length of the static mixer.

In a further aspect the present invention relates to a method of assembling a static mixer, comprising a mixer housing, a mixing element and a mixer inlet section that are formed as separate elements, the method comprising the steps of:

engaging a plug element of the mixing element and a counter plug element of the mixer inlet section;

guiding the engaging mixing element and mixer inlet section into the mixer housing to arrange at least a part of the mixing element within the mixer housing; wherein the mixing element and the mixer inlet section are plugged together in a rotationally fixed manner by a plugged connection.

Advantageously the static mixer used in such a method can be further developed in accordance with the static mixer described herein.

In a further aspect the present invention relates to a use of a static mixer of the kind described herein or of a dispensing apparatus of the kind described herein in order to dispense components from a multi-component cartridge via the static mixer.

In a further aspect the present invention relates to a mixer inlet section. The mixer inlet section comprises a counter plug element of the kind described herein.

In a further aspect the present invention relates to a mold for the mixer inlet section. The mold is then adapted such that it provides recesses and undercuts matching the negative shape of the mixer inlet section in a similar manner as the static mixer described in the foregoing.

In a further aspect the present invention relates to a mixing element. The mixing element comprises a plug element of the kind described herein.

In a further aspect the present invention relates to a mold for the mixing element. The mold is then adapted such that it provides recesses and undercuts matching the negative shape of the mixing element in a similar manner as the static mixer described in the foregoing.

Likewise, the method in accordance with the invention can be adapted in a similar manner as the static mixer and/or the dispensing apparatus described in the foregoing.

BRIEF DESCRIPTION OF THE DRAWINGS

The invention will be explained in more detail hereinafter with reference to the drawings.

DETAILED DESCRIPTION

Figure 1A:
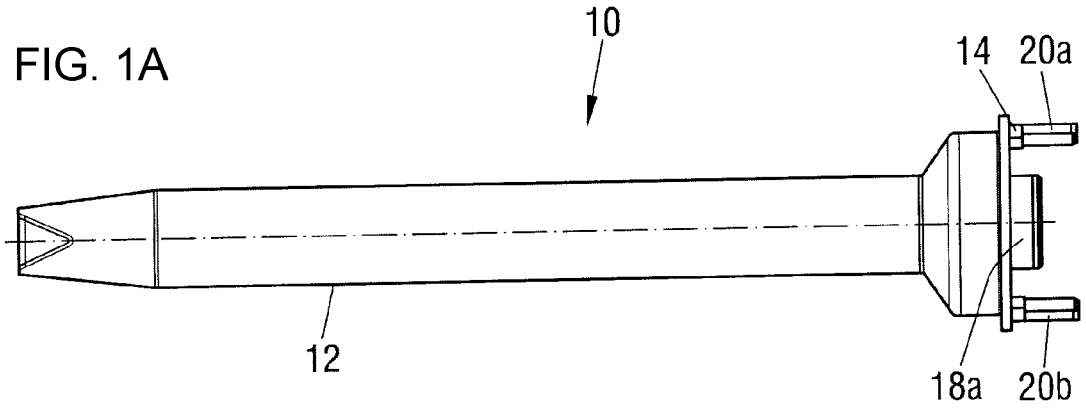
FIGS. 1A and 1B are a first type of static mixer in a first type of mixer housing.

In the following the same reference numerals will be used for parts having the same or equivalent function. Any statements made having regard to the direction of a component are made relative to the position shown in the drawing and can naturally vary in the actual position of application.

FIG. 1A shows a side view of a first type of static mixer 10 having a first type of mixer housing 12. The mixing element 16 (see FIG. 1A) and part of the mixer inlet section 14 (see FIG. 1B) are arranged within the mixer housing 12. One inlet 18*a* into the mixer inlet section 14 can be seen, as can alignment means or device 20*a*, 20*b* by which the mixer inlet section 14 is aligned relative to a cartridge 100 (see FIG. 9).

Figure 1B:
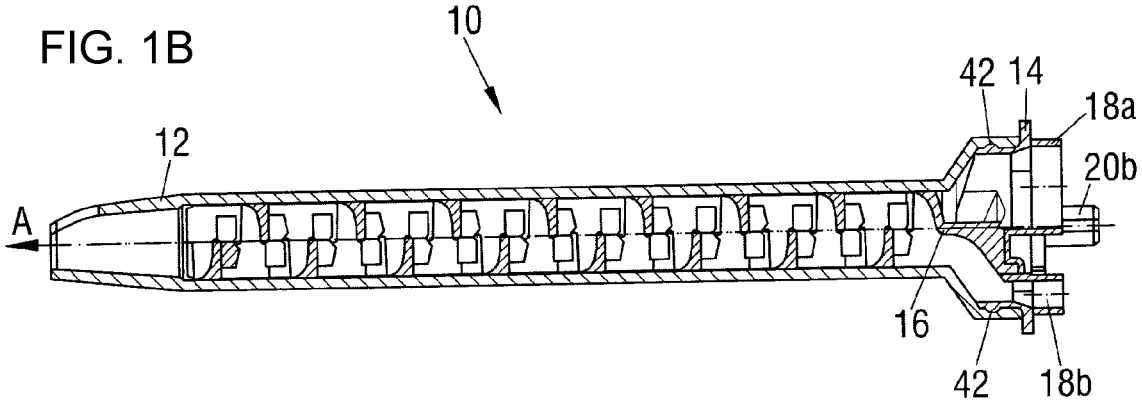

FIG. 1B shows a section through the static mixer 10 of FIG. 1A when the static mixer 10 is rotated by 90° about the longitudinal axis A. Both of the inlets 18*a*, 18*b* into the mixer inlet section 14 can be seen in this position. Furthermore, the mixing element 16 is arranged within the mixer housing 12.

Figure 2A:
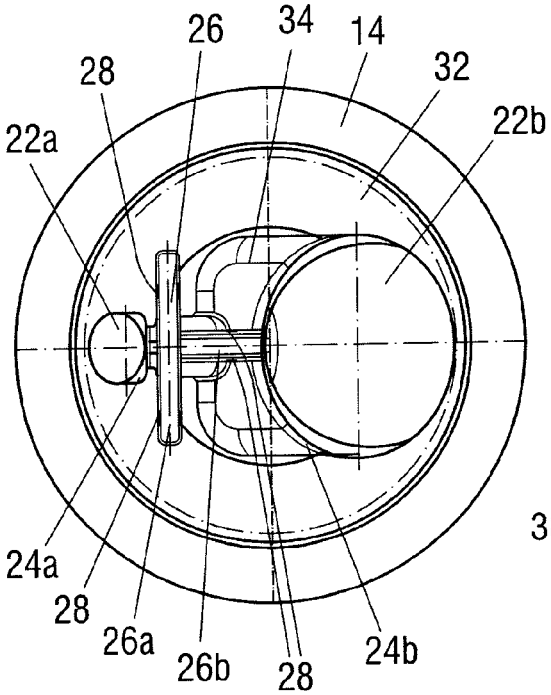
FIGS. 2A to 2E are a first type of mixer inlet section.

FIGS. 2A-2E show various views of the mixer inlet section 14 of FIGS. 1A and 1B. FIG. 2A shows a top view of the mixer inlet section 14. The mixer inlet section 14 has a generally circular shape in the top view. The mixer inlet section 14 has two outlets 22*a*, 22*b* each having an outlet opening 24*a*, 24*b*. A counter plug element 26 is arranged between the outlets 22*a*, 22*b*. In the present example the counter plug element 26 is configured as a socket.

The counter plug element of FIG. 2A is formed by a first groove 26*a* and a second groove 26*b* extending transverse thereto. Noses 28 are disposed within the first and second grooves 26*a*, 26*b*. The noses 28 are adapted to cooperate with a plug element 30 (see FIGS. 3A to 3C) such that they frictionally engage the plug element 30 to fix the plug element 30 relative to the counter plug element 26.

The counter plug element 26 is configured such that the plug element 30 can only be inserted in one direction into the mixer inlet section 14. Thereby the shape of the counter plug element 26 acts as coding element for the insertion of the generally T-shaped end of the plug element 30.

The outlet openings 24*a*, 24*b* are respectively formed in an output surface 32 of the mixer inlet section 14. Adjacent to the outlet opening 24*b* a recess 34 is formed within the outlet 22*b*. The recess 34 expands a volume of the outlet 22*b* relative to the inlet 18*b*.

The recess 34 has an elongate shape and thereby enlarges and directs a flow path of a component 102*b* (see FIG. 10), flowing from the inlet 18*b* to the outlet 22*b*. The recess 34 thereby acts as a guide reservoir for the component 102*b* that flows into the mixing element 16.

The guide reservoir enables the component 102*b* to be directed into inlets 36 (see FIGS. 3A to 3C) of the mixing element 16, so that an ideal point of entry for the component 102*b* into the inlets 36 can be selected.

In order to improve the introduction of the components 102*a*, 102*b* into the mixing element 16, the outlets 22*a*, 22*b* of the mixer inlet section 14 are spaced less far apart than the corresponding inlets 18*a*, 18*b*.

The outlet opening 24*a* is approximately a tenth of the size of the outlet opening 24*b*. This is because the mixer inlet section 14 is used for multi-components having a medium to high mixing ratio such as 4:1 and 10:1, this means that one of the components is introduced into the mixing element at a ratio of 4:1 or 10:1 with respect to the other component.

Figure 2B:
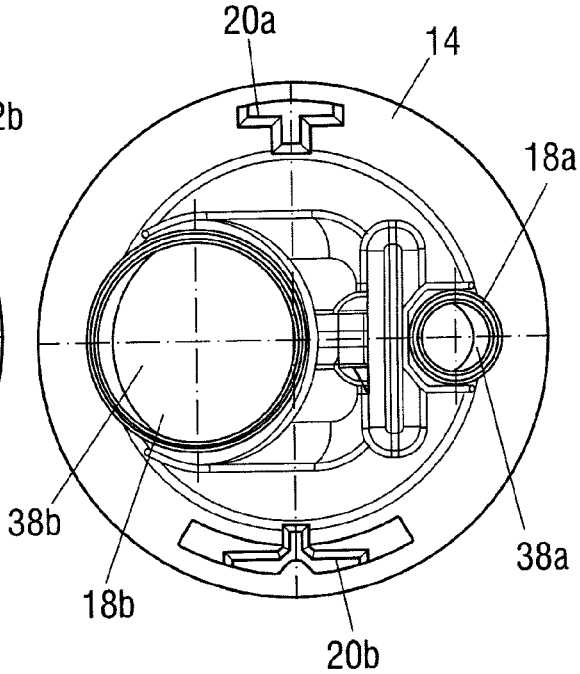

FIG. 2B shows a bottom view of the mixer inlet section 14. The inlets 18*a*, 18*b* have a substantially circular shaped inlet opening 38*a*, 38*b*. The shape of the inlet opening is selected so that the inlets 18*a*, 18*b* can be connected to outlets of a cartridge 100 (see FIG. 10).

The inlets 18*a*, 18*b* are in fluid communication with the respective outlets 22*a*, 22*b*, so as to guide components from the cartridge 100 to the mixing element 16.

The alignment devices 20*a*, 20*b* are used in order to align the mixer inlet section 14 with the cartridge 100. In order to connect the mixer inlet section 14 of the static mixer 10 to the cartridge 100 in a coded and aligned manner the alignment devices 20*a*, 20*b* have a different size so that these can only be positioned in one way. Moreover, the alignment devices 20*a*, 20*b* have a generally T-shaped cross-section for this purpose. An attachment means or device (not shown) such as a retainer nut can additionally be used to, at least intermittently fixedly, connect the static mixer 10 to the cartridge 100.

Having regard to the high ratio mixer inlet section, the inlets 18*a*, 18*b* are also of different size so that these can only be placed on to the cartridge 100 in one way and thereby also act as a coded alignment devices.

Figure 2C:
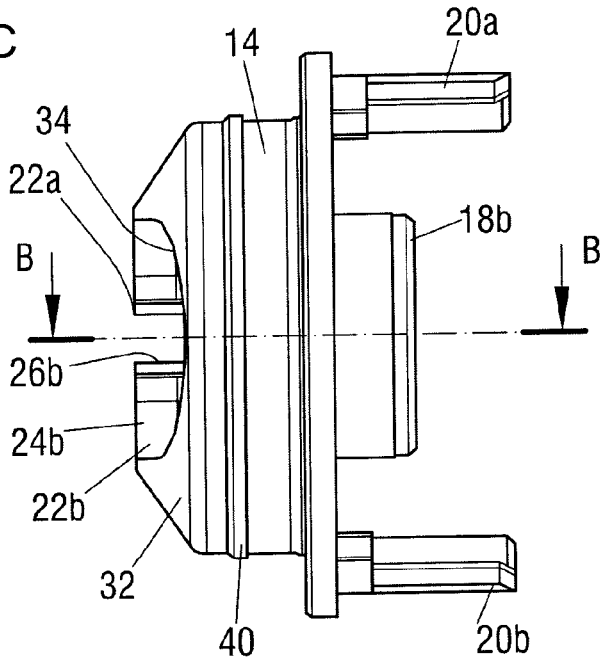

FIG. 2C shows a side view of the mixer inlet section 14 of FIG. 2A. The outlets 22*a*, 22*b* of the mixer inlet section 14 are connected to one another via a volume forming at least a part of the counter plug element 26. Once the plug element 30 cooperates with the counter plug element 26, the outlets 22*a*, 22*b* are separated from one another by the plug element 30 (see FIGS. 4A and 4B).

Moreover, one can see a side view of the generally T-shaped alignment devices 20*a*, 20*b* in FIG. 2C.

The mixer inlet section 14 has a projection 40 arranged adjacent to the output surface 32. This projection is adapted to cooperate with a groove 42 (see FIG. 1B) arranged in the mixer housing 12 in order to latch the mixer housing 12 to the mixer inlet section 14.

Figure 2D:
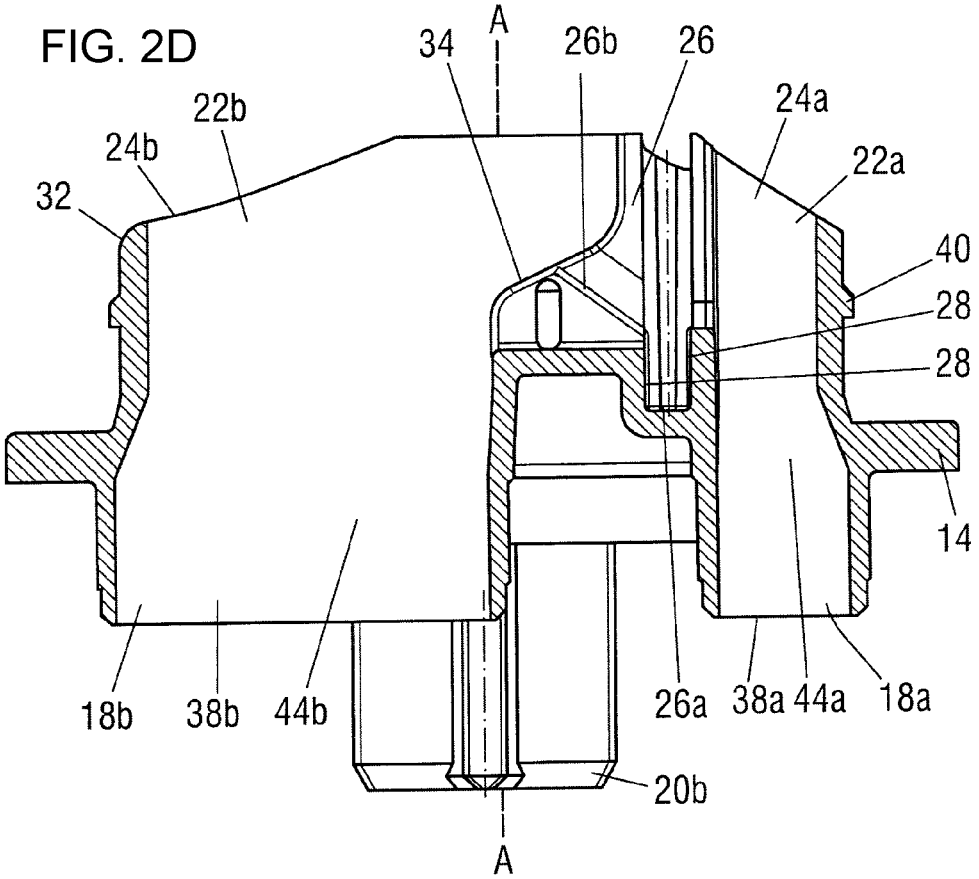

FIG. 2D shows a section through the mixer inlet section 14 along the sectional line B-B of FIG. 2C. The outlet 22*b* is arranged such that at least a part of the outlet opening 24*b* is arranged around the longitudinal axis A of the static mixer. Thereby the component is guided from the inlet 18*b* to the mixing element 16.

One can see how the flow path 44*b* between the inlet 18*b* and the outlet 22*b* is directed towards the longitudinal axis A. Through the provision of the recess 34, the diameter of the flow path 44*b* (the same is true in analogy for the flow path 44*a*) experiences no constrictions in the region of the outlet 22*b*. This is because a distance between the mixer housing 12 and the recess 34 is selected such that the diameter of the flow path 44*b* is kept at least substantially equal throughout the mixer inlet section 14 and up to the mixing element 16. For this reason the flow of the component 102*b* experiences significantly less flow resistance on its passage through the mixer inlet section 14 up to the mixing element 16 on being discharged from the cartridge 100 in comparison to prior art static mixers (not shown). Likewise the flow path 44*a* between the inlet 18*a* and the outlet 18*b* is shifted towards the longitudinal axis A.

Figure 2E:
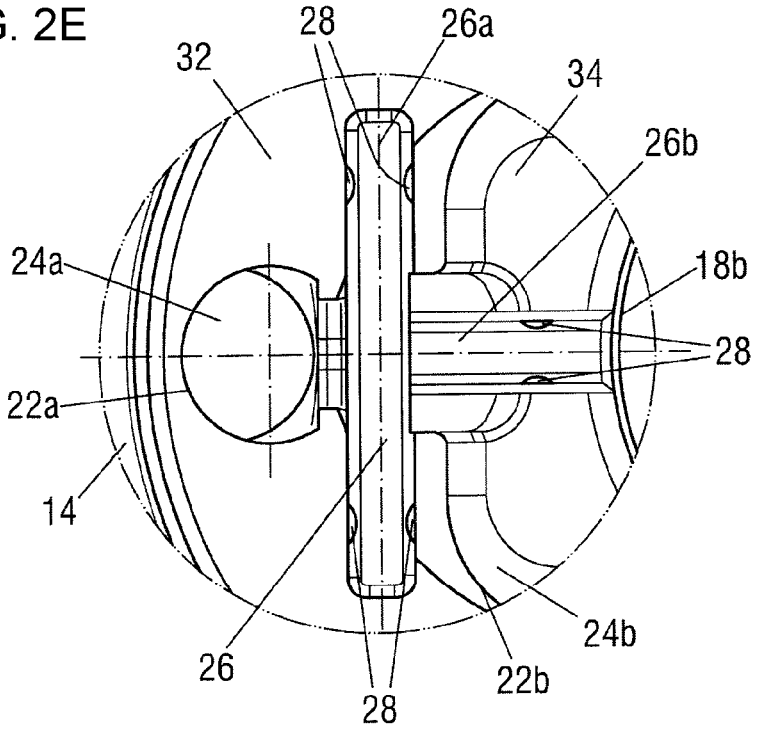

FIG. 2E shows an enlarged view of the generally T-shaped counter plug element 26. The outlets 22*a* and 22*b* are connected to one another via the counter plug element 26. The connection is closed once the plug element 30 is inserted into the counter plug element 26 (see FIG. 4). Furthermore, four noses 28 are visible in the region of the first groove 26*a*. The four noses 28 are configured to engage the corresponding plug element 30.

Figure 3A:
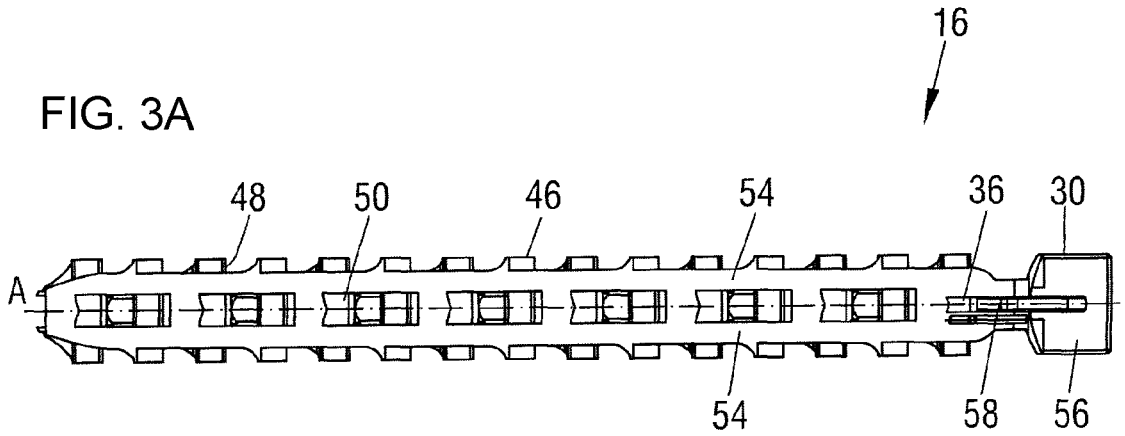
FIGS. 3A to 3C are a first type of mixing element.
Figure 3B:
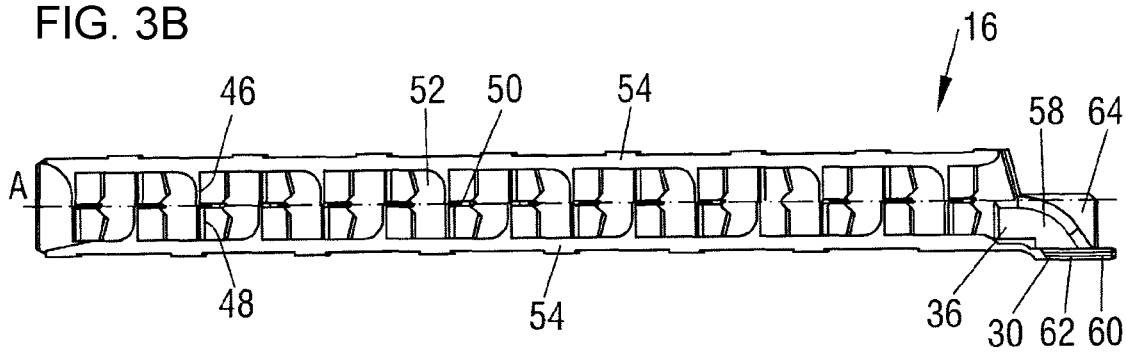
Figure 3C:
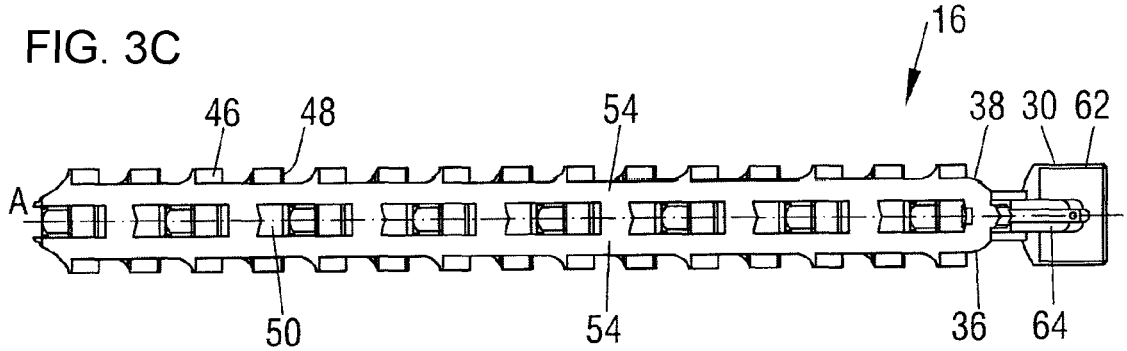

FIGS. 3A to 3C show various views of a first type of mixing element 16. The mixing element 16 comprises mixer elements 46 for separating the material to be mixed into a plurality of streams, as well as layered merging of the same. The layered merging is accomplished by a structure that comprises transverse edges 48 and guide walls 50 that extend at an angle to the transverse edges 48, as well as guide elements 52 arranged at an angle to the longitudinal axis A and including openings.

The individual mixer elements 46 are connected to one another by struts 54, with the struts 54 also acting as further guide and deflecting walls. The number of mixer elements 46 and the corresponding length of the struts 54 is selected in dependence on the kind of material that is to be dispensed with a certain static mixer 10. For some applications five mixer elements 46 may be sufficient whereas for others ten or more mixer elements 46 may need to be connected to one another by struts 54.

FIG. 3A shows a side view onto the mixing element 16. At the right hand side of the mixing element 16, there is a plug element 30. This is composed of a wall section 56. Some of the wall section 56 has a U-shaped cross-section that leads into a T-shaped cross-section. A groove 58 is formed in the wall section 56 that extends from the T-shaped cross-section through the U-shaped cross-section and towards an inlet 36 of the mixing element 16.

FIG. 3B indicates how this groove extends from a surface 60 of the plug element 30 towards the inlet 36 of the mixing element 16. The groove thereby extends the flow path 44*a* from the mixer inlet section 14 into the mixing element 16 (see also FIG. 4 in this regard).

FIG. 3C like FIG. 3B shows how the T-shaped wall section 56 is formed by a first wall 62 and a second wall 64 extending transverse thereto. The groove 58 is formed extending from the surface 60 within the second wall 64 towards the inlet 36 of the mixing element 16.

Figure 4B:
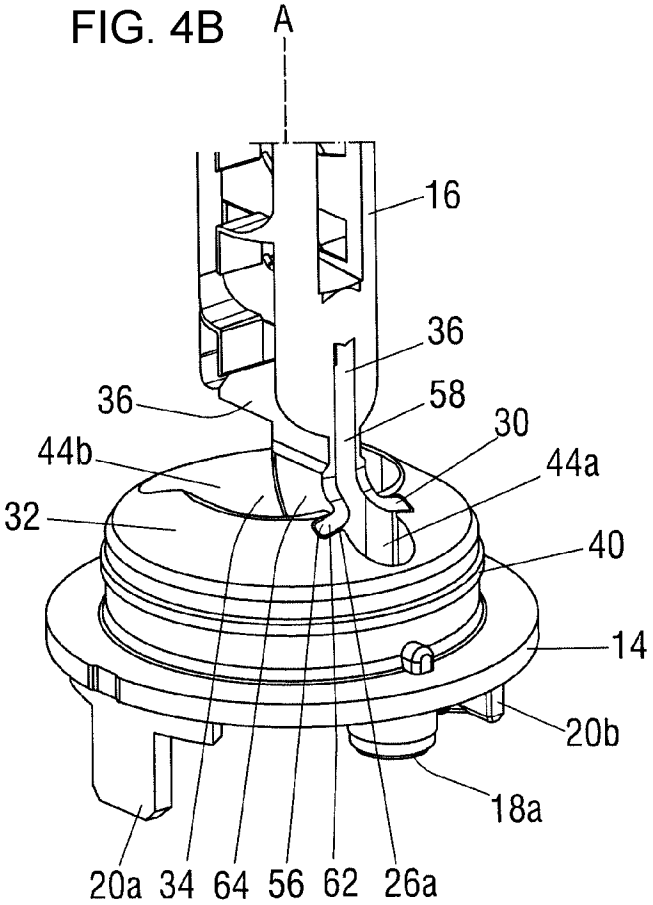
FIGS. 4A and 4B are perspective part views of the first type of static mixer.
Figure 4A:
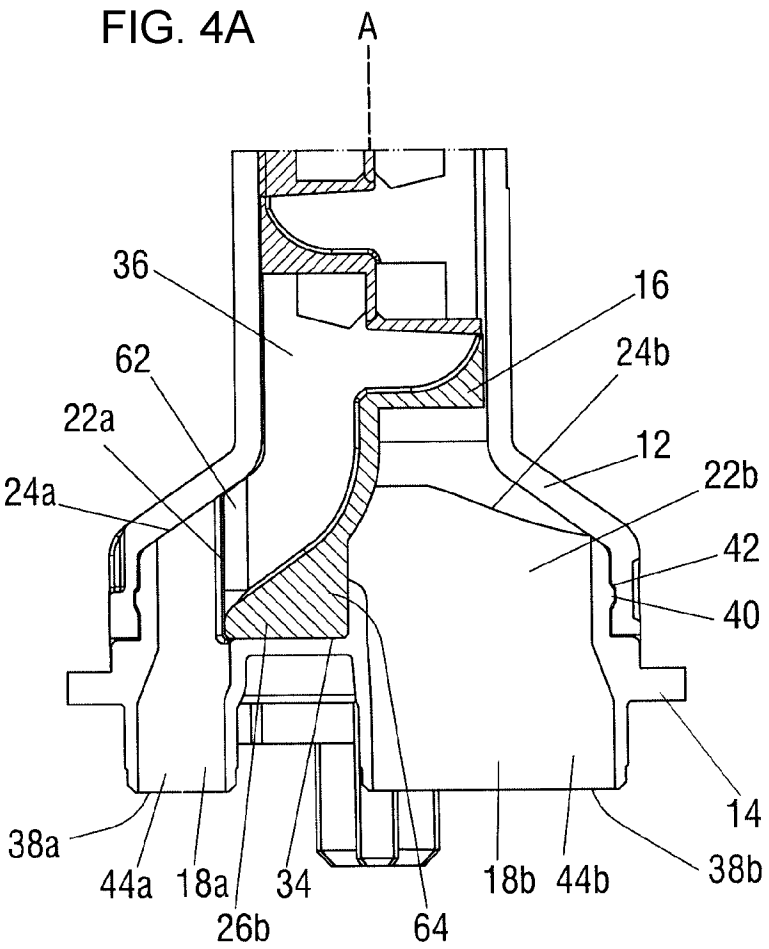

FIGS. 4A and 4B show perspective part views of the first type of static mixer 10. In particular one can see how the flow path 44*a* extends from the inlet 18*a* of the mixer inlet section 14 via the outlet 22*a* and the groove 58 towards one of the inlets 36 of the mixing element 16.

Likewise the flow path 44*b* extends from the inlet 18*b* via the outlet 22*b* of the mixer inlet section towards inlets 36 of the mixing element 16. The flow path 44*a* is smaller in diameter than the flow path 44*b*, as the mixer inlet section 14 and the mixing element 16 currently employed are used for high mixing ratios of e.g. 4:1 and 10:1.

Moreover, the section shown in FIG. 4A indicates how the flow path 44*b* is enlarged in the region of the outlet 22*b* in comparison to the inlet 18*b*. This enlargement of the flow path 44*b* is further highlighted in FIG. 4B where one can see how the flow path 44*b* extends around the second wall 64 up to the first wall 62 of the wall section 56 of the mixing element 16. The flow path 44*b* is extended such that it comes into contact with substantially the whole width of the mixing element 16 in the region of the inlets 36 where it extends around the second wall 64. The region of the outlet 22*b* is arranged such that the component 102*b* flowing through the flow path 44*b* arrives in a directed manner at the inlet 36 of the mixing element 16.

Both FIGS. 4A and 4B show that the flow paths 44*a*, 44*b* are shifted with respect to the longitudinal axis A from the inlets 18*a*, 18*b* towards the longitudinal axis A in the regions of the outlets 22*a*, 22*b*. Thereby the components 102*a*, 102*b* flow into the mixing element 16 in a more directed manner and can be introduced into the mixing element 16 in an optimum way, so that a mixing result is improved. This also leads to a reduction in the length of the mixing element 16 and hence to a reduction in the residual volume remaining in the static mixer 10.

Moreover, the shift of the flow paths 44*a*, 44*b* takes place within the mixer inlet section 14, so that a spacing between the mixer inlet section 14 and the mixing element 16 can be reduced leading to a further reduction in the residual volume remaining in the static mixer 10. This is advantageously achieved in a mixer inlet section 14 having the same height as prior art mixer inlet sections (not shown).

Figure 5A:
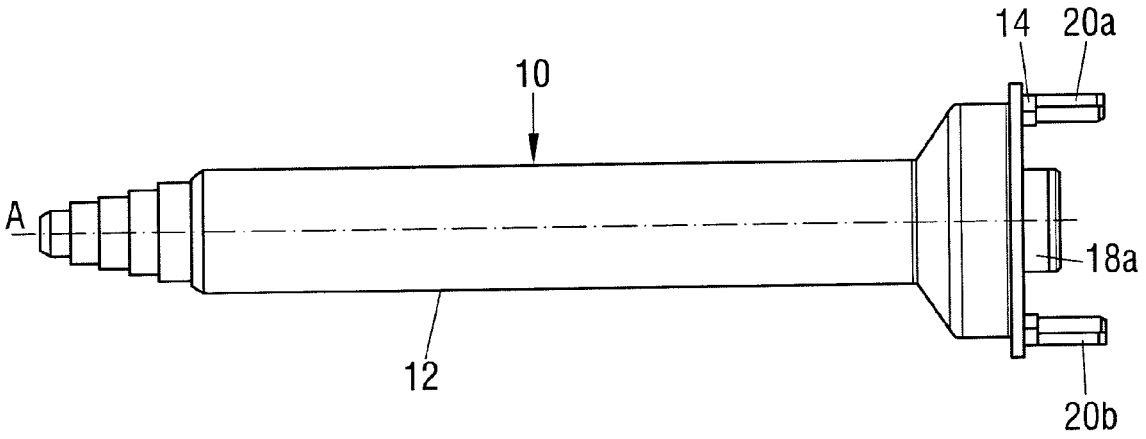
FIGS. 5A and 5B a second type of static mixer in a second type of mixer housing.
Figure 5B:
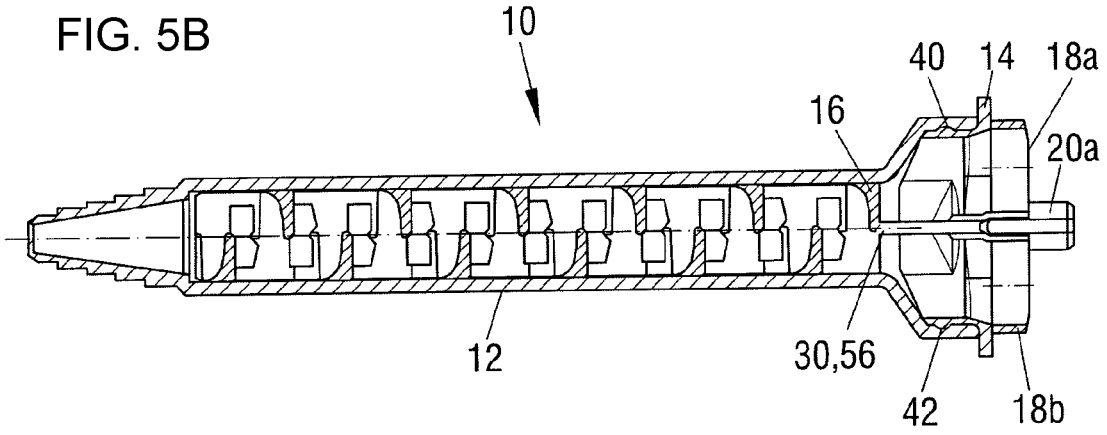

FIGS. 5A and 5B show a second type of static mixer 10 in a second type of mixer housing 12. The mixer is typically used for low ratio mixing of components such as 1:1 or 2:1.

Figure 6A:
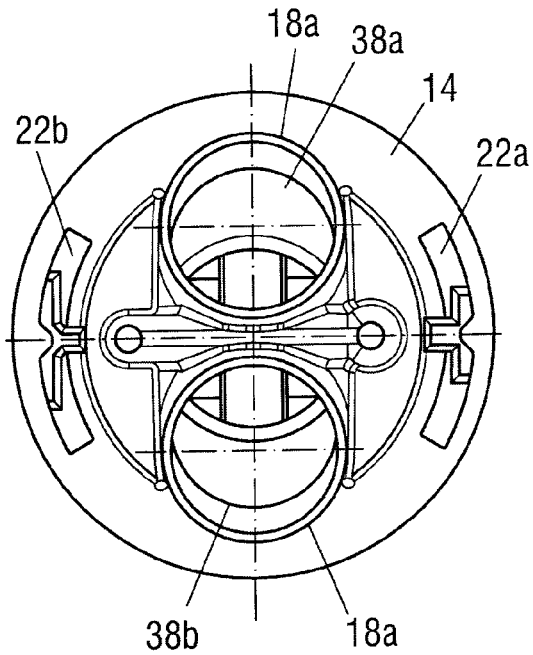
FIGS. 6A to 6E are a second type of mixer inlet section.

FIGS. 6A to 6E show a second type of mixer inlet section 14 designed for 1:1 and 2:1 mixing ratios. FIG. 6A shows a bottom view of the mixer inlet section 14 in which the inlets 18*a*, 18*b* and the corresponding inlet openings 38*a*, 38*b* are of equal size.

Figure 6B:
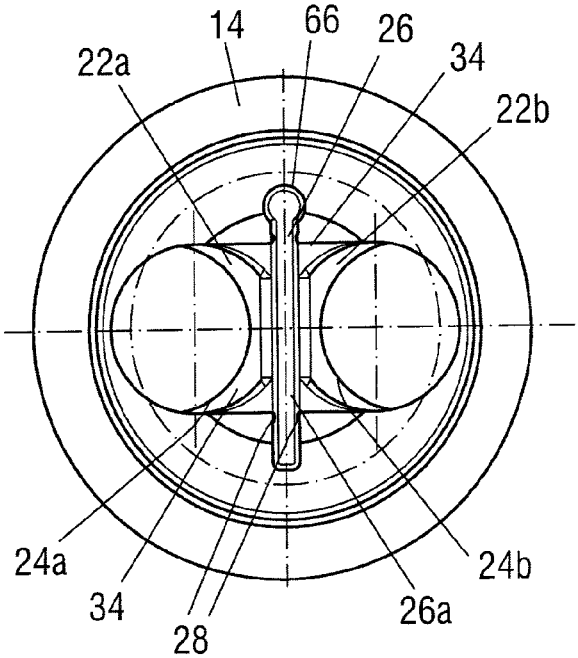

FIG. 6B shows a top view of the mixer inlet section 14 in which the outlets 22*a*, 22*b* and the corresponding outlet openings 24*a*, 24*b* are of equal size. A counter plug element 26 having only a first groove 26*a* extends between the outlets 22*a*, 22*b*. A recess 66 is arranged at an end of the first groove 26*a*. This recess 66 is adapted to cooperate with a bulge 68 (see FIG. 7) configured at the plug element 30 of the mixing element 16.

Figure 6C:
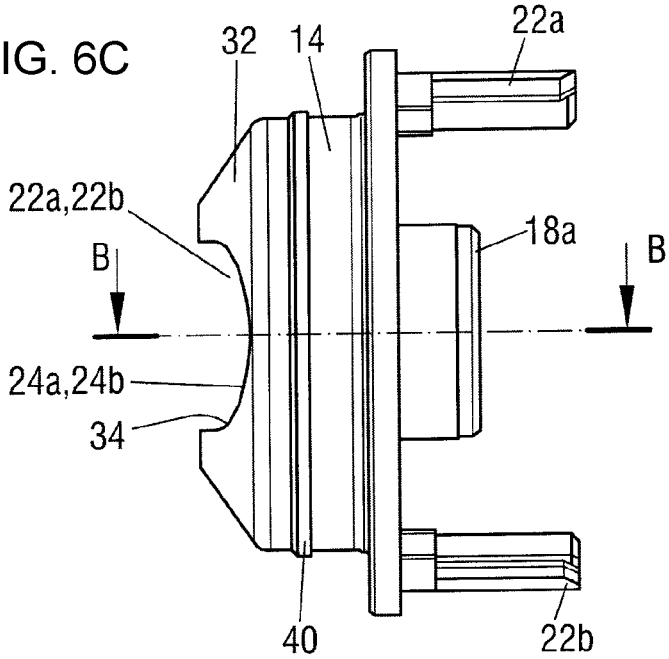

As the outlets 22*a*, 22*b* have the same size, the side view of FIG. 6C appears to have a continuous outlet opening 24*a*, 24*b*. As can be seen from FIG. 6D this is because the mixer inlet section 14 has a free space extending into the recess 34 and adjacent to the first groove 26*a* into which free space the plug element 30 of the mixing element 16 is inserted to separate the outlets 22*a*, 22*b* from one another so that a mixing of components only takes place once the components enter the mixer elements 46 of the mixing elements 16.

Like with the outlet 22*b* of FIGS. 2A to 2E, both of the outlets 22*a*, 22*b* have a recess 34 adjacent to the output surface 32. This recess 34 expands a volume of the respective outlet 22*a*, 22*b* in an elongate way to form a component flow guide region adjacent to the output surface 32. The component flow guide region acts as a region in which the components 102*a*, 102*b* can flow into the inlets 36 of the mixing element 16 in a directed manner. In order to complement the directed flow of the components a shape of an inlet surface of the mixer housing 12 is adapted to the shape of the output surface 32 of the mixer inlet section 14. In the present example the output surface 32 has a part spherical shape.

Figure 6D:
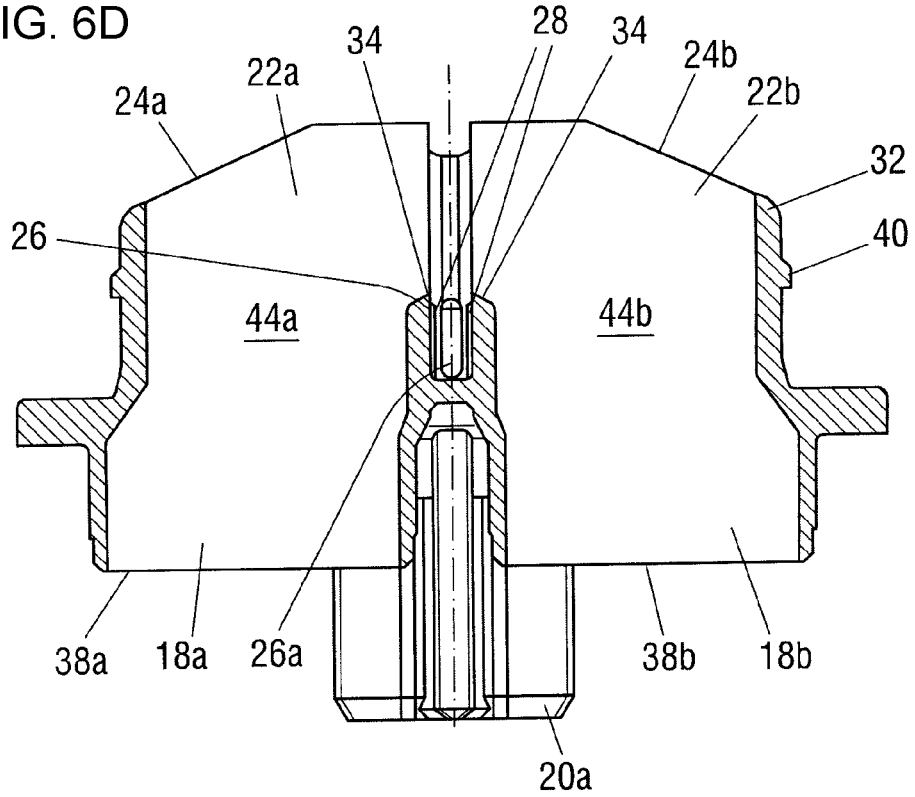

As can be seen in the section of FIG. 6D, the inlets 18*a*, 18*b* start merging into the outlets 22*a*, 22*b* at approximately a third of the length between the inlet openings 38*a*, 38*b* and a top most part of the outlet openings 24*a*, 24*b*. The outlets start at approximately two third of a length between the inlet openings 38*a*, 38*b* and a top most part of the outlet openings 24*a*, 24*b*. The same is true for the example shown in FIG. 2A to 2E.

Figure 6E:
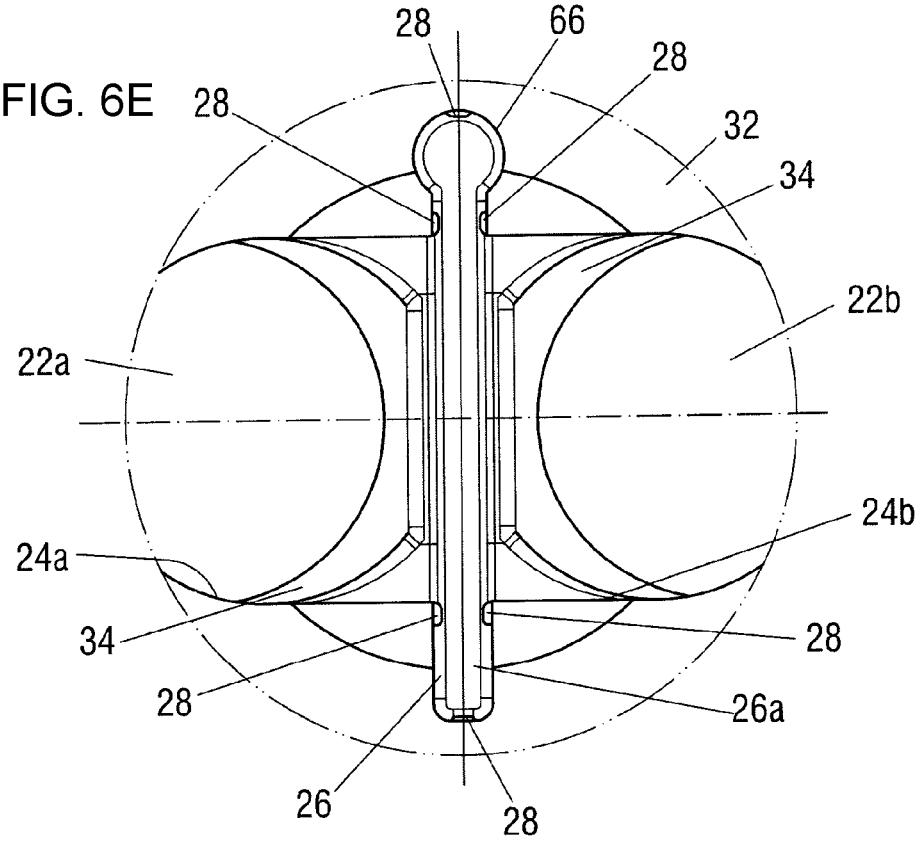

FIG. 6E shows an enlarged view of the region of the first groove 26*a*. A nose 28 is visible within the recess 66. This, like the other noses 28 configured in the first groove 26*a*, is designed to frictionally engage the wall section 56 of the plug element 30 when the plug element 30 cooperates with the counter plug element 26.

Figure 7A:
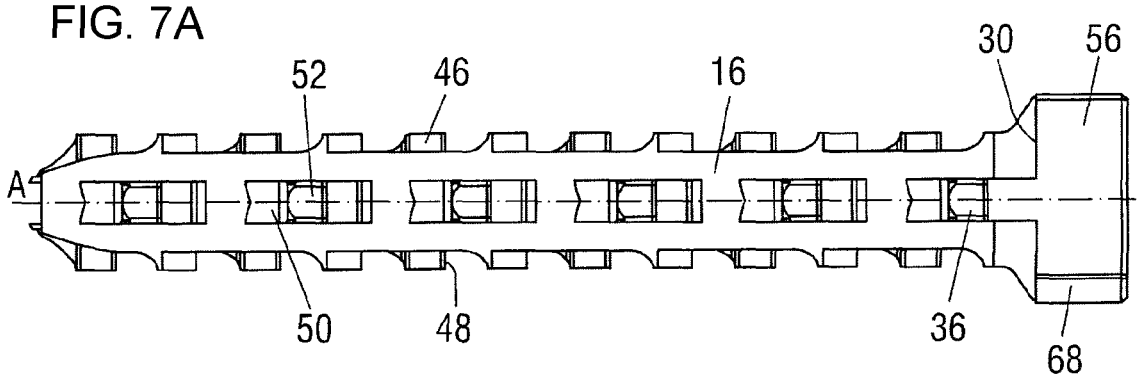
FIGS. 7A to 7C a second type of mixing element.
Figure 7B:
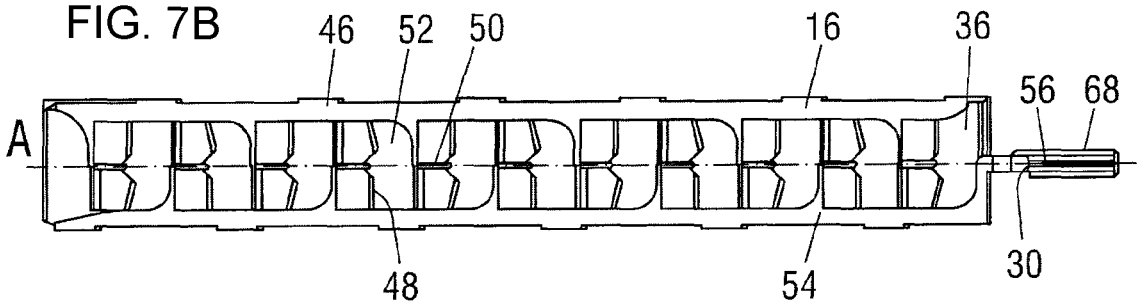
Figure 7C:
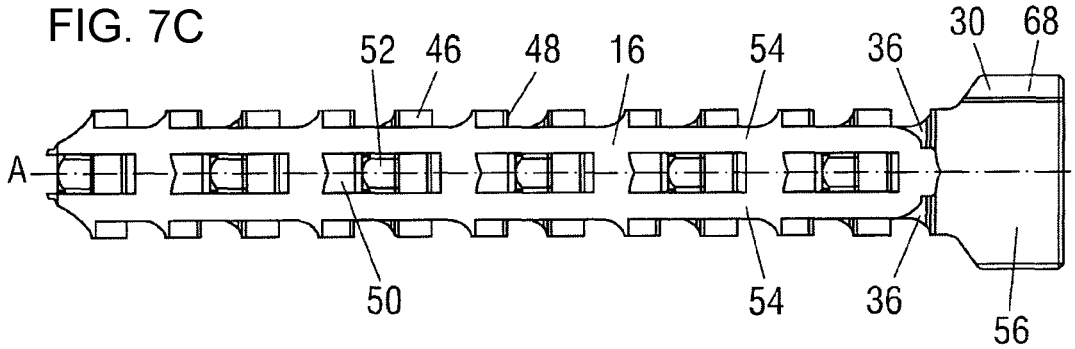

FIGS. 7A to 7C show perspective views of a second type of mixing element 16. The mixer elements 46 of the mixing element 14 are configured like the embodiment shown in FIGS. 3A to 3C. The difference is to be seen in the wall section 56 of the plug element 30.

The wall section 56 shown in the side view of FIG. 7A has a generally planar shape with a bulge 68 configured at an end thereof. The bulge 68 is configured so that it extends substantially in parallel with the longitudinal axis A.

FIG. 7B shows a further side view when the mixing element 14 is rotated by 90° about the longitudinal axis A. One can see how the wall section 56 has a thinner diameter in comparison to the bulge 68.

FIG. 7C shows a further rotation of the mixing element 14 by 90° about the longitudinal axis A. Now the bulge 68 is positioned at the top of the wall section 56 of the plug element 30. The bulge 68 is a coded alignment element, so that the plug element 30 can only be plugged into the counter plug element 26 of the mixer inlet section 14 of FIG. 6A to 6E in one way.

Figure 8B:
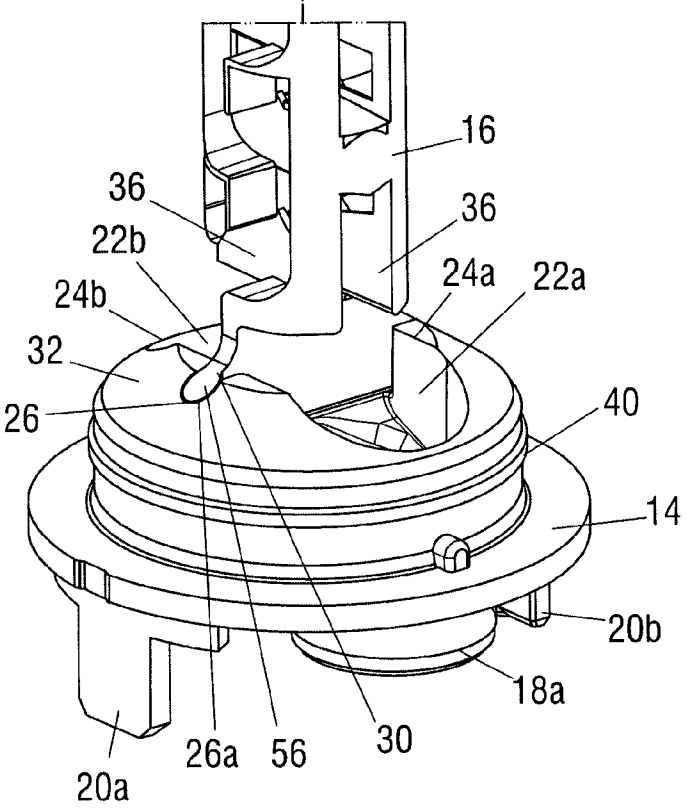
FIGS. 8A and 8B are perspective part views of the second type of static mixer.
Figure 8A:
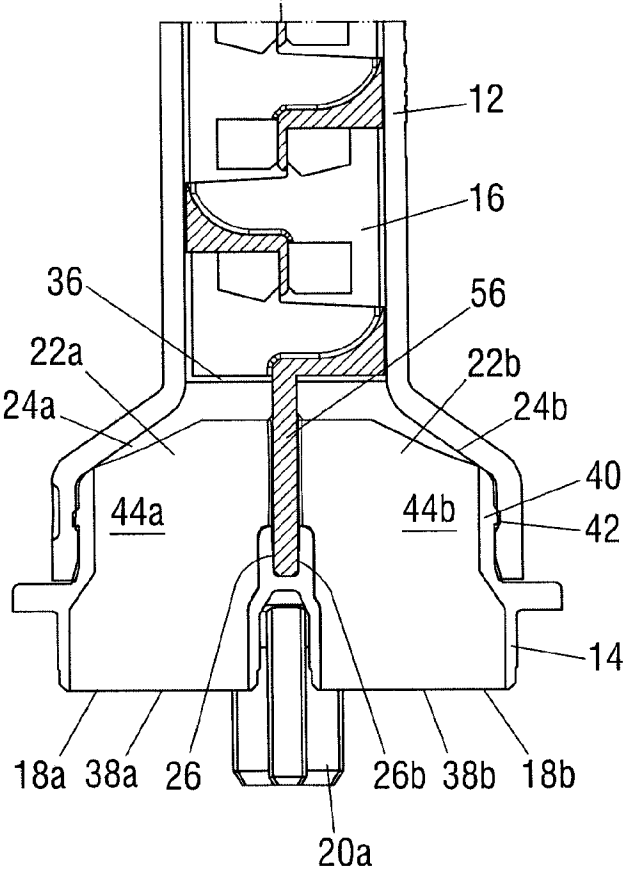

FIGS. 8A and 8B show perspective part views of the second type of static mixer 10. Both flow paths 44*a*, 44*b* are directed from the inlets of the mixer inlet section 14 to the inlets 36 of the mixing element 16. Thereby a geometric center of the outlet openings 24*a*, 24*b* is spaced less far from the longitudinal axis A than a geometric center of the inlet openings 38*a*, 38*b* to direct the flow path 44*a*, 44*b* of the components 102*a*, 102*b* towards the inlets 38.

Figure 9:
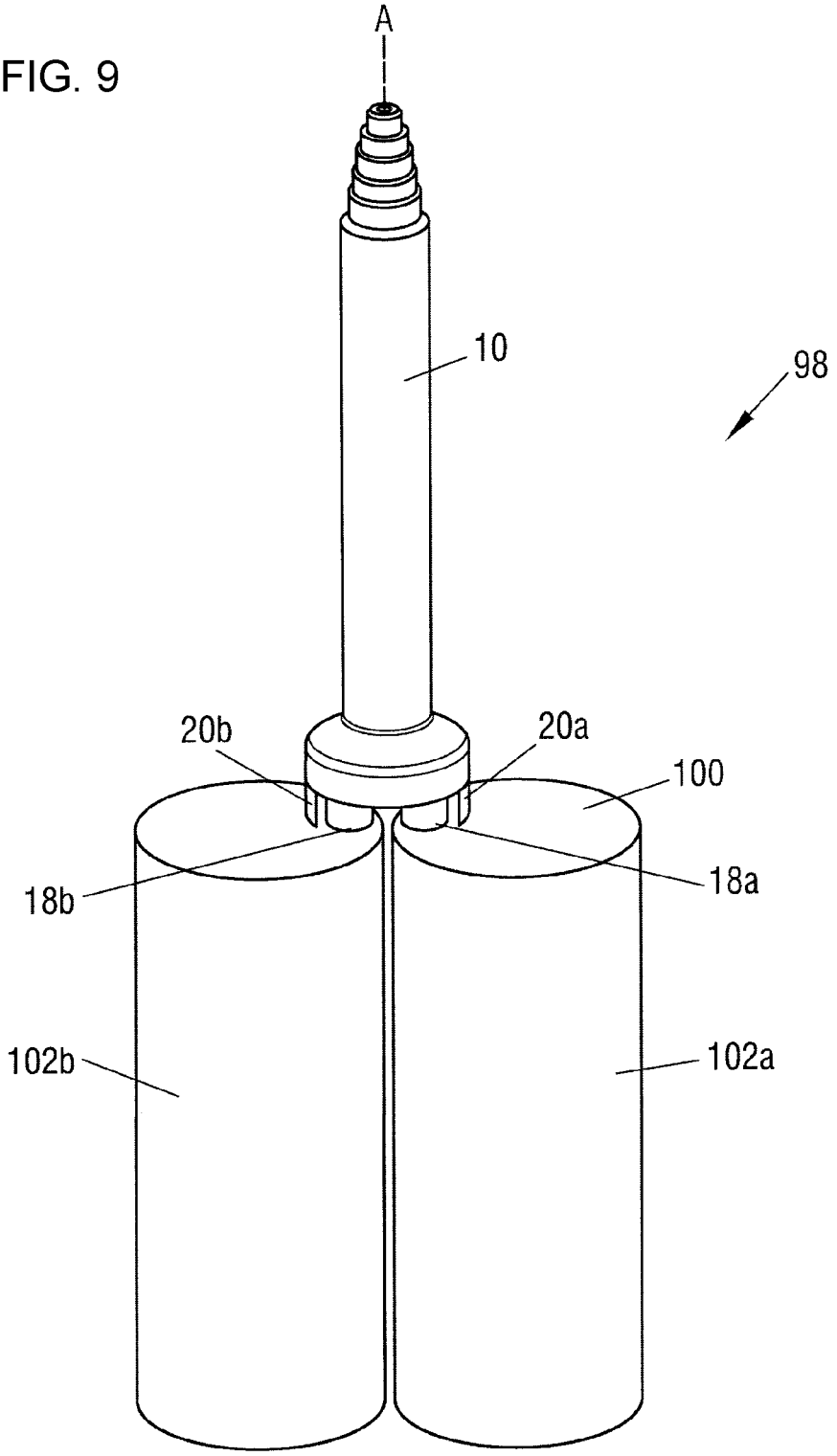
FIG. 9 is a dispensing apparatus.

FIG. 9 shows a dispensing apparatus 98 comprising a multi-component cartridge 100 and a static mixer 10. The multi-component cartridge 100 is filled with respective components 102*a*, 102*b*. The components 102*a*, 102*b* can be discharged from the cartridge 100 by a plunger (not shown) into the inlets 18*a*, 18*b* of the mixer inlet section 14 of the static mixer 10. The static mixer 10 is connected to the cartridge 100, on the one hand, by the alignment elements 20*a*, 20*b* for a coded alignment between the static mixer 10 and the cartridge 100. On the other hand, the static mixer 10 is connected to the cartridge 100 by a retainer nut (not shown). The retainer nut is adapted to cooperate with the cartridge 100 and engages the mixer housing 12 of the static mixer 10 in order to fix the static mixer 10 to the cartridge 100.

Figure 10:
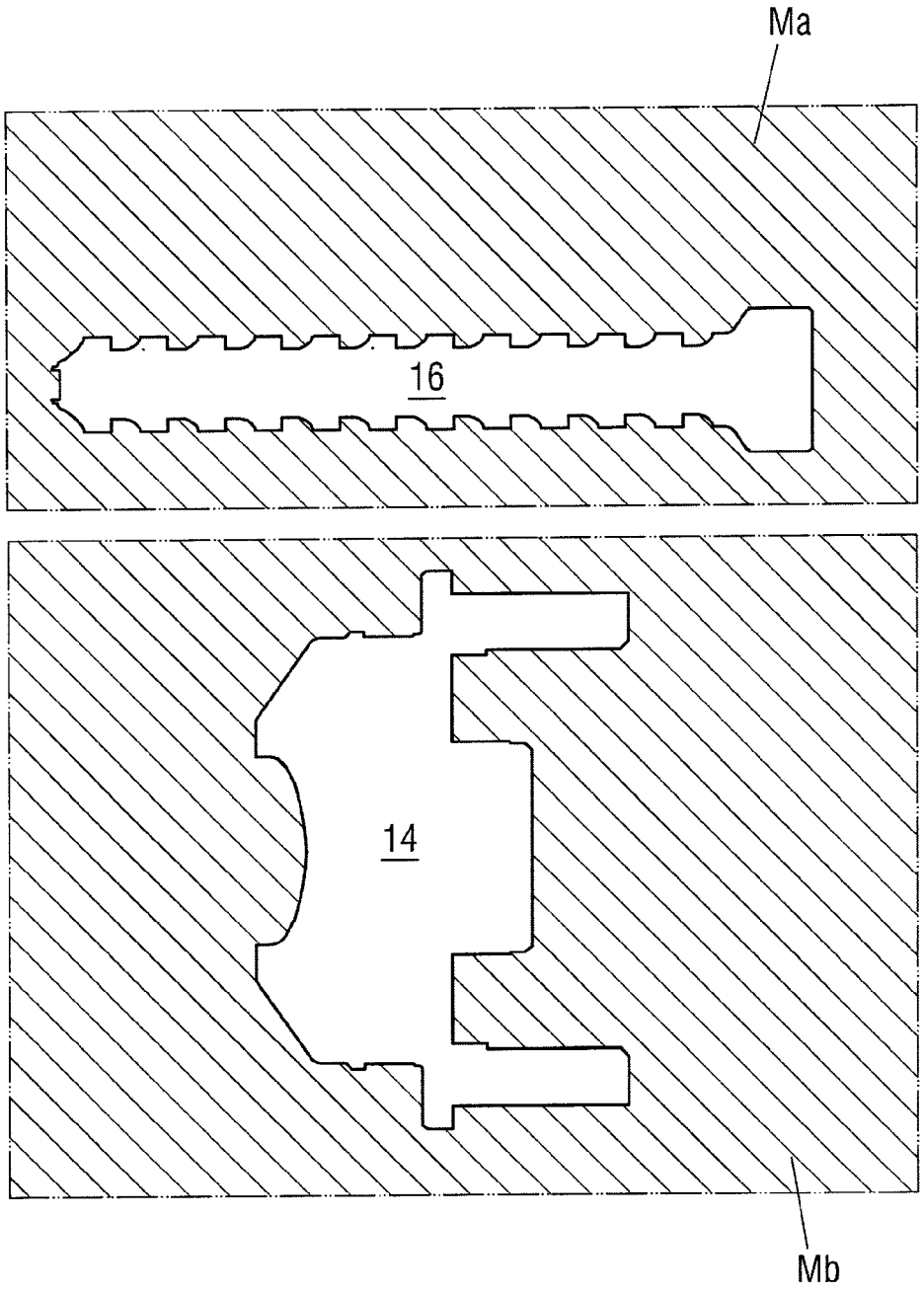
FIG. 10 is sectional views of molding devices.

FIG. 10 shows a schematic sectional view of a molding device Ma for a mixing element 16 as described herein, and a sectional view of a molding device Mb for a mixer inlet section 14 as described herein. The molding devices have respective inputs for the components to be injected (not shown) and for any required vacuum apparatus (also not shown). In order to mold the specific components, inserts specific for any shapes of the components are also introduced into the molding devices Ma, Mb.

Using the molding devices Ma, Mb mixer inlet sections 14 and mixing elements 16 as described herein can be produced.

The invention claimed is:

1. A static mixer for mixing together at least two components, comprising:

a mixer housing;

a mixing element arranged at least partly within the mixer housing; and a mixer inlet section having at least two inlets disposed at an input side and at least two outlets disposed at an output surface, the at least two outlets being in fluid communication with the at least two inlets, the mixer inlet section including first and second aligners configured to enable the mixer inlet section to detachably connect to outlets of a cartridge in an aligned manner, and the mixer housing, the mixing element and the mixer inlet section being separate elements, the mixing element including a plug element and the mixer inlet section including a counter plug element engaging the plug element, the plug element and the counter plug element forming a plugged connection when the plug element engages the counter plug element, and the mixing element and the mixer inlet section being configured to be plugged together in a rotationally fixed manner by the plugged connection.

2. The static mixer according to claim 1, wherein the mixing element and the mixer inlet section are held together in an axial direction by the plugged connection that is formed by the plug element and the counter plug element or by at least one element of the mixer inlet section cooperating with at least one element of the mixer housing.

3. The static mixer according to claim 2, wherein the plugged connection comprises a clamping connection or a frictional connection, the clamping connection or the frictional connection being at least one nose frictionally engaging one of the mixer inlet section and the mixing element, or a latching connection of the plug element and the counter plug element.

4. The static mixer according to claim 1, wherein the mixing element and the mixer inlet section are aligned in a fixed predefined rotational angular relationship by the plug element and the counter plug element.

5. The static mixer according to claim 4, wherein the plug element and the counter plug element comprise a coding element cooperating with a corresponding recess or groove, enabling the mixing element and the mixer inlet section to be plugged together only in the predefined rotational angular relationship.

6. The static mixer according to claim 1, wherein the plug element comprises a wall section disposed at an input end of the mixing element and the counter plug element comprises a groove disposed at the output surface.

7. The static mixer according to claim 6, wherein the wall section is arranged between the at least two outlets so as to separate the at least two components when the at least two components leave the at least two outlets before entering inlets of the mixing element.

8. The static mixer according to claim 6, wherein the wall section has a straight planar shape, or comprises a thickened end, or has at least partially a U-shaped cross section, or has at least partially a T-shaped cross section.

9. The static mixer according to claim 1, wherein the at least two inlets have respective inlet openings and the at least two outlets have outlet openings, with the outlet openings being formed in the output surface of the mixing inlet section, and a surface area of at least one of the inlet openings is smaller than a surface area of a corresponding outlet opening.

10. The static mixer according to claim 1, wherein the output surface of the mixer inlet section has an at least substantially slanted contour at an outlet side of the mixer inlet section with respect to a longitudinal axis of the static mixer, with the outlet side being disposed remote from the inlet side, with the at least substantially slanted contour of the output surface being adapted to a shape of an inlet surface of the mixer housing.

11. The static mixer according to claim 9, wherein the static mixer has a longitudinal axis and at least two flow paths extend between the at least two inlet and outlet openings, and each inlet and outlet opening has a geometric center, with the geometric center of at least one of the at least two outlet openings being spaced less far apart from the longitudinal axis than the geometric center of at least one of the at least two inlet openings.

12. The static mixer according to claim 11, wherein, in a region of the at least two outlets, the at least two flow paths are configured to cooperate with the mixer housing, to provide a component flow guide region at inlets of the mixing element, and the at least two outlets of the mixer inlet section are arranged to at least partly overlap with inlets of the mixing element.

13. The static mixer in accordance with claim 11, wherein at least one region of at least one of the at least two outlets adjacent to the corresponding outlet opening is configured such that a cross-section thereof perpendicular to a respective one of the at least two flow paths is enlarged in comparison to the corresponding inlet, such that the flow path extending between the inlet opening and the outlet opening is directed and enlarged in a direction towards at least one inlet of the mixer element.

14. The static mixer in accordance with claim 1, wherein at least one recess is disposed at an outlet side of the mixer inlet section, one of the at least two outlets opens into a base of the at least one recess and a cross-sectional area of the at least one recess is larger than a cross-sectional area of the one of the at least two outlets, and the depth of the recess in an axial direction amounts to at least a third of the diameter of the outlet, or is equal to or larger than the diameter of the outlet, with the at least one recess having a cross-sectional shape that deviates from a circle such that the at least one recess has an elongate shape that extends towards a longitudinal axis, or the at least one recess is connected to the other one of the at least two outlets or to a further recess in a direction transverse to the longitudinal axis.

15. The static mixer in accordance with claim 1, wherein the mixing element comprises a plurality of mixer elements arranged one after another for a repeated separation and re-combination of streams of the at least two components, either the mixing element comprises mixer elements for separating the at least two components into a plurality of streams, as well as a structure for layered merging of the at least two components, the structure including a transverse edge and guide walls that extend at an angle to the transverse edge, as well as guide elements arranged at an angle to the longitudinal axis and including openings, and the mixing element comprises a transverse edge and a following transverse guide wall and at least two guide walls ending in a separating edge each with lateral end sections and with at least one bottom section disposed between the guide walls, thereby defining at least one opening on one side of the transverse edge of the mixing element and at least two openings on the other side of the transverse edge of the mixing element, or the mixing element comprises mixer elements for separating the at least two components into a plurality of streams, as well as the structure for the layered merging of the at least two components, including separating edges and the transverse edge that extends at an angle to the separating edges, as well as deflecting elements arranged at an angle to the longitudinal axis and including openings, and the mixing element comprises at least two separating edges with following guide walls with the lateral end sections and with the at least one bottom section disposed between the guide walls, and the transverse edge arranged at one end of the transverse guide wall, thereby defining the at least one opening on the one side of the transverse edge and the at least two openings on the other side of the transverse edge.

16. A dispensing apparatus comprising:

the cartridge; and the static mixer according to claim 1 connected to the cartridge, with the cartridge being capable of being filled with the at least two components.

17. A method of assembling a static mixer including a mixer housing, a mixing element and a mixer inlet section are formed as separate elements, the method comprising:

engaging the plug element of the mixing element and the counter plug element of the mixer inlet section;

guiding the engaged mixing element and mixer inlet section into the mixer housing to arrange at least a part of the mixing element within the mixer housing, plugging the mixing element and the mixer inlet section together in a rotationally fixed manner by a plugged connection, the static mixer further developed in accordance with claim 1.

18. A method of mixing together and dispensing at least two components, comprising:

operating the static mixer in accordance with claim 1 to dispense the at least two components.

19. A method of mixing together and dispensing at least two components, comprising:

operating the dispenser in accordance with claim 16 to dispense the at least two components.

* * * * *